United States Patent [19]

Fontenot

[11] Patent Number: 4,697,650

[45] Date of Patent: Oct. 6, 1987

[54] METHOD FOR ESTIMATING FORMATION CHARACTERISTICS OF THE EXPOSED BOTTOMHOLE FORMATION

[75] Inventor: John E. Fontenot, Houston, Tex.

[73] Assignee: NL Industries, Inc., New York, N.Y.

[21] Appl. No.: 654,186

[22] Filed: Sep. 24, 1984

[51] Int. Cl.[4] ..... E21B 47/00

[52] U.S. Cl. ..... 175/50; 73/151; 73/151.5

[58] Field of Search ..... 166/250, 254; 175/40, 175/48, 50; 73/151, 151.5, 152; 367/81-86; 340/853-861

[56] References Cited

U.S. PATENT DOCUMENTS

| | | | |
|---|---|---|---|
| 2,365,014 | 12/1944 | Silverman et al. . | |
| 2,539,758 | 1/1951 | Silverman et al. . | |
| 3,235,026 | 2/1966 | Hottman | 175/50 |
| 3,237,094 | 2/1966 | Blackburn et al. | 175/50 |
| 3,345,867 | 10/1967 | Arps . | |
| 3,368,400 | 2/1968 | Jorden, Jr. et al. . | |
| 3,420,099 | 1/1969 | Bennett et al. . | |
| 3,581,564 | 6/1971 | Young, Jr. . | |
| 3,620,077 | 11/1971 | Brown et al. | 73/151.5 |
| 3,626,482 | 12/1971 | Quichaud et al. . | |
| 3,722,606 | 3/1973 | Fertl et al. | 175/50 |
| 3,766,993 | 10/1973 | Fertl et al. | 175/50 |
| 3,770,378 | 11/1973 | Russell | 175/50 |
| 3,785,446 | 1/1974 | Fertl et al. | 175/50 |
| 3,800,277 | 3/1974 | Patton et al. | 175/48 |
| 3,863,203 | 1/1975 | Patton et al. | 175/40 |
| 3,898,880 | 8/1975 | Kelseaux et al. | 73/151.5 |
| 3,916,684 | 11/1975 | Rundell . | |
| 3,921,732 | 11/1975 | Reynolds et al. | 175/50 |
| 3,982,432 | 9/1976 | Hammond . | |
| 4,078,620 | 3/1978 | Westlake . | |
| 4,216,536 | 8/1980 | More | 340/856 |
| 4,346,593 | 8/1982 | Howells et al. | 73/152 |

OTHER PUBLICATIONS

"Analysis of Rock Properties from Drilling Response", by W. A. Zoeller, SPWLA Fifteenth Annual Logging Symposium, 1974.

"The Drilling Porosity Log 'DPL'", by W. A. Zoeller, Society of Petroleum Engineers of AIME, 1970.

"Rock Properties Determined from Drilling Response", by W. A. Zoeller, *Petroleum Engineer*, Jul. 1974.

*Primary Examiner*—Stephen J. Novosad
*Assistant Examiner*—Bruce M. Kisliuk
*Attorney, Agent, or Firm*—Browning, Bushman, Zamecki & Anderson

[57] ABSTRACT

The present invention is directed to an apparatus and method for estimating the value of a parameter of the formation face being penetrated by the drill bit in a drilling operation. The present invention is particularly useful for providing real-time, contemporaneous data concerning the formation face being penetrated for use by the drilling operator or geologist in modifying the drilling operation. The present invention provides a system for estimating the value of one or more parameters of the formation face being penetrated by measuring-while-penetrating one or more measurable parameters of the formation face being penetrated and comparing these values to a data base comprising sets of correlated values for formation parameters of other borehole locations, each set comprising at least a value of the measured parameter and of the parameter of interest. Furthermore, the present invention provides a method and apparatus capable of constantly updating the data base as the borehole is drilled to constantly improve the data base and the estimated values.

17 Claims, 4 Drawing Figures

METHOD FOR ESTIMATING FORMATION CHARACTERISTICS OF THE EXPOSED BOTTOMHOLE FORMATION

BACKGROUND OF THE INVENTION

1. Field of the Invention

The present invention generally relates to an apparatus and method useful for estimating the value of a parameter of a downhole formation. The present invention comprises a particularly useful method for determining the value of a parameter of the formation face being penetrated by the drill bit in realtime during the actual penetration. More particularly, the present invention relates to a method for estimating the value of a parameter of the formation face being penetrated by comparing the value of a measurement-while-penetrating (MWP) parameter of the formation face with prior acquired and correlated data.

2. Description of the Background

The desirability of logging a borehole during or immediately after drilling has long been recognized by those associated with drilling operations. However, borehole logging for many years was exclusively performed by wireline tools lowered into the borehole after removal of the drilling apparatus therefrom. These wireline logging operations, requiring the tripping of the drill string, resulted in lost drilling time and greatly increased costs. Further, changes in the values of various formation parameters occurred during the delay between the actual drilling of a formation and the performance of these wireline logs. For example, leakage of drilling fluids or formation fluids across the boreholes wall during this delay often resulted in the production of inaccurate and incorrect logs. Finally, the results of wireline logging are often not available to the drilling operator and geologist until many hours after a formation has been penetrated.

For many reasons, including those set forth above, those skilled in the art have long recognized the desirability of performing borehole logging operations while drilling. In recent years, there has been significant interest in the development and use of measurement-while-drilling (MWD) systems. However, only recently have appropriate tools and methods to perform logging operations while drilling become available. The actual MWD tools must be resistant to the constantly vibrating drill string and the prolonged exposure to the harsh borehole environment. Further, these tools must be sufficiently strong to withstand the stresses in the drill string and sufficiently small to avoid interference with the operation of the drill string and its associated downhole systems.

Although it is theoretically possible to store the data acquired by MWD tools in a microcomputer or other downhole storage device for transfer to appropriate data processing devices at the surface upon retrieval from the borehole, these systems have not found widespread use. Contemporaneous analysis permits the drilling operator or geologist to immediately detect changes in the near bottom hole conditions and to make any necessary or desirable adjustments in the drilling operation. In order to maximize the benefits of MWD systems, it is necessary to transmit the data immediately to the surface for analysis. Typical telemetry systems include systems for transmitting electrical signals through electrical conductors embedded in or on the drill string, systems for transmitting acoustic signals through the drill string or the drilling fluids and systems for imparting measurable pressure pulses to the drilling fluids.

Although these MWD systems are vast improvements over wireline logging systems, they still suffer from a time lag between the time a new formation face is penetrated and the time the MWD sensors are adjacent the face for measurement. This time lag may be as short as several minutes or as long as several hours. During this time lag, changes may occur at the formation face.

More importantly, the drilling operator and geologist are unaware of the values of the parameters of the formation face actually being penetrated. The MWD data provided to the drilling operator or geologist is characteristic of the formation at the location of the MWD sensors. These sensors are typically located in a drill collar several feet, e.g., ten to fifteen feet, above the drill bit. Accordingly, the drilling operator or geologist is unaware of the values of the parameters at a given location until the borehole has actually progressed to a greater depth so that the MWD sensors are adjacent the given location. The inherent time lag is a function of both the penetration rate and the distance separating the drill bit and the MWD sensors. The time lag is directly proportional to the separation between the drill bit and the MWD sensors and inversely proportional to the rate of penetration. During this lag period, the drilling operator and the geologist are uninformed concerning the values of the parameters of the actual formation face being penetrated.

The advent of MWD technology has decreased the lag time between the time a formation is actually penetrated and the time data characteristic of the formation is available to the drilling operator and geologist. The safety and efficiency of the drilling operation has been improved with this knowledge, permitting evaluation of the formation and modification of the drilling operation as necessary or desirable. However, this analysis and modification is still based upon MWD data obtained as much as several hours after a formation is penetrated. The benefits of MWD information would be maximized if this lag time could be eliminated by providing the drilling operator and geologist with data characteristic of the formation face being penetrated contemporaneously with penetration.

Accordingly, there has been a long felt but unfulfilled need within the borehole logging industry for an apparatus and method useful in providing information concerning the formation face being penetrated contemporaneously with penetration of that face.

SUMMARY OF THE INVENTION

The present invention provides a new and improved apparatus and method for estimating the value of a parameter of the formation face being penetrated by the drill bit in a drilling operation. The invention provides a system for estimating the value of a parameter of the formation face being penetrated by measuring the value of a first parameter of the formation face being penetrated and comparing the measured value of the first parameter to values of the same measured parameter for other borehole locations in a data base comprising a plurality of sets of values of correlated formation parameters. Each set of values of formation parameters comprises values of formation parameters for a different borehole loaction and each set comprises at least a value of the first parameter measured while penetrating and a value of the parameter to be determined. Although in its simplest embodiment the comparison is performed visually using graphically illustrated analog data or tabulated digital data, it is preferred that the comparison be performed by a computer employing conventional means to determine the set within the data base whose values for the first parameter is closest to the measured value of the first parameter of the face being penetrated.

In a preferred embodiment, a plurality of parameters of the formation face being penetrated are measured and compared to a plurality of values for the same parameters in the sets comprising the data base to improve the accuracy of the estimation. In another embodiment of the present invention, one or more values indicative of one or more formation parameters in the data base are measured after penetration, preferably while drilling, correlated with the value or values of the parameter or parameters measured while penetrating for that location and added to the data base. In this presently most preferred embodiment, the data base is continually being expanded to improve the accuracy of the estimated parameter values.

The apparatus and method of the present invention solve a long felt but unfulfilled need of the MWD industry for an apparatus and method for accurately estimating the value of one or more formation parameters contemporaneous with actual penetration of the formation face. The apparatus and method of the present invention provide the desired estimates by measuring the value of one or more readily measurable parameters of the formation face being penetrated and comparing the measured values to values in a data base comprising sets of values for other borehole locations and including values for the measured parameters and for the parameters of interest, often parameters unmeasurable while penetrating. Accordingly, estimates of the values of the parameters of interest are obtained in real-time, contemporaneously with actual penetration of the formation. These and other meritorious features and advantages of the present invention will be more fully appreciated from the following detailed description and claims.

BRIEF DESCRIPTION OF THE DRAWINGS

Other features and intended advantages of the present invention will be more readily apparent by the reference to the following detailed description in connection with the accompanying drawings, wherein.

While the invention will be described in connection with the presently preferred embodiment, it will be understood that it is not intended to limit the invention to this embodiment. On the contrary, it is intended to cover all alternatives, modifications and equivalents as may be included in the spirit of the invention as defined in the appended claims.

DETAILED DESCRIPTION OF THE PREFERRED EMBODIMENT

The present invention is directed to an apparatus and method useful for determining or estimating the value of a parameter of the formation face being penetrated by the drill bit in a drilling operation. In the presently preferred embodiment, a plurality of parameters, often unmeasurable at the penetration face while drilling, are estimated by measurement of a plurality of measurable parameters of the formation face being penetrated and comparison to previously measured and correlated values of parameters for a plurality of prior borehole locations. Further, the apparatus and method of the present invention provide the capability to continuously update and expand the data base to provide increasingly accurate estimations.

Figures 1, 2:
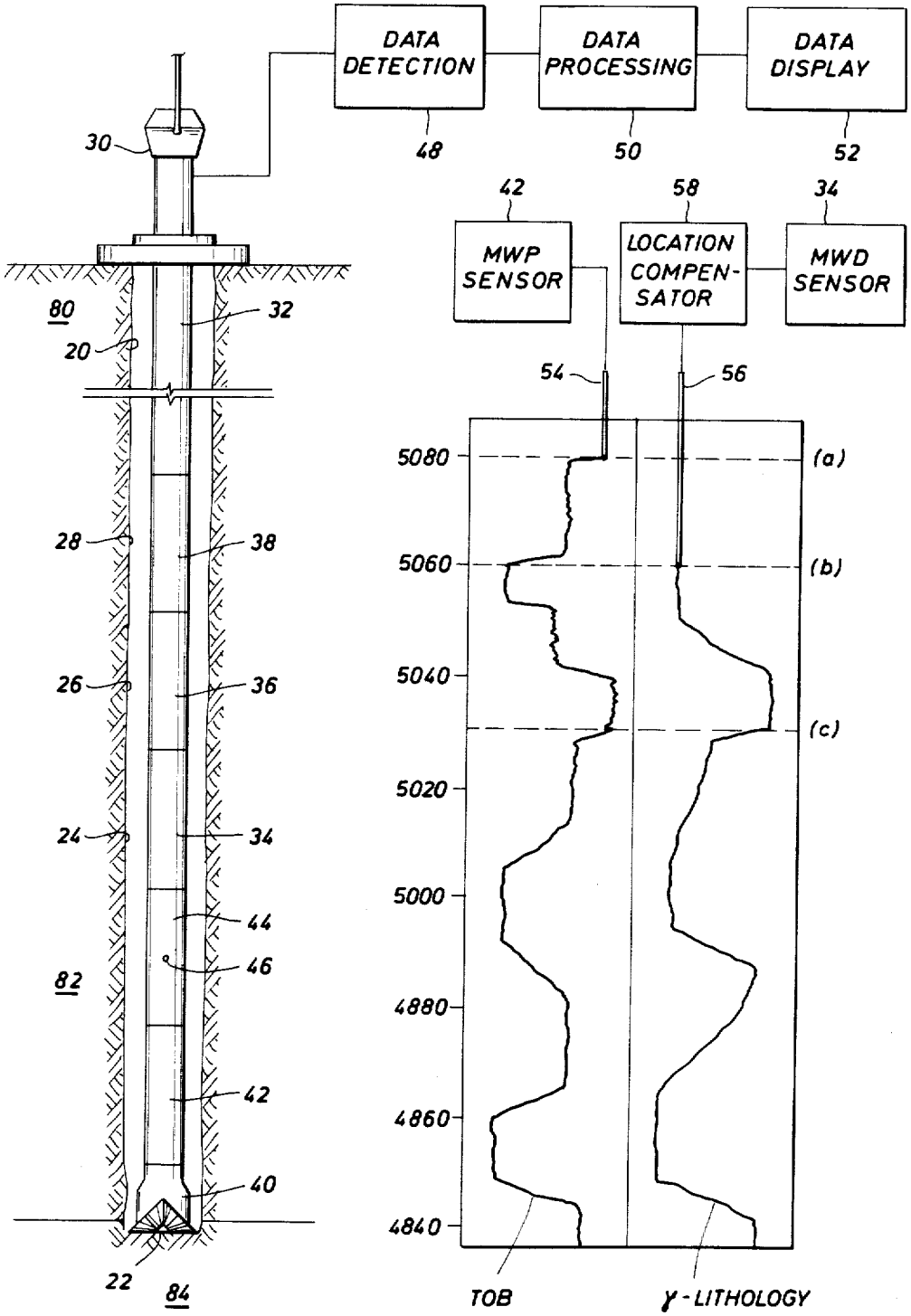
FIG. 1 is a schematic illustration of a well bore including a drill string and apparatus for estimating the value of a parameter of the formation face being penetrated in accord with the present invention.
FIG. 2 is an illustration of an analog graphical representation of the value of a parameter measured while penetrating and of the value of a parameter later measured while drilling from which the value of the MWD parameter of the formation face being penetrated may be visually estimated in accord with the present invention.

FIG. 1 illustrates schematically an apparatus in accord with the present invention. Drilling apparatus 30 includes a drill string 32 having a bit 40 attached to the end thereof for penetrating the earth 80 to produce a borehole 20. The drill string 32 often includes a drill collar 44 located proximate the drill bit 40 for transmitting information to the surface. Conventional telemetry systems include systems for transmitting encoded data by electrical signals transmitted by electric conductors embedded in or on the sections of the drill string, by acoustic signals transmitted through the drill string or the drilling fluid in the annulus or by pressure pulses transmitted through the drilling fluid in the drill string. The illustrative example of FIG. 1 includes a negative pressure pulse telemetry system having a gated passageway 46 through the side wall of a drill collar 44 for discharging a portion of the drilling fluid within the drill string 32 to the annulus of the borehole about the drill string 32. This telemetry system produces negative pressure pulses detectable at the surface by appropriate pressure transducers 48 and decoded and processed by conventional circuitry or computer means 50. An exemplary negative pressure pulse telemetry system is disclosed in U.S. Pat. No. 4,078,620 which is incorporated herein by reference. This exemplary system discloses a system for venting drilling fluids through a passage in the wall of a drill sub from the interior of the sub to the annulus in order to impart negative pulses to the pressure of the drilling fluid in the drill string. These negative pulses are indicative of coded information to be transmitted from the borehole location to the surface where the negative pulses are detected and the data decoded.

The apparatus comprises means 50 for decoding, processing, correlating and comparing the transmitted data with previously obtained measurements correlated into a plurality of data sets comprising a data base. The presently most preferred means for completing these tasks comprises a digital computer 50. Programming a conventional computer means 50 to decode, compile, compare, correlate, store and display incoming data is within the skill of those in the art. Visual output is provided by a data display 52. In a simple embodiment, the present invention comprises mere visual comparison of values for the various formation parameters of interest displayed and recorded on a strip chart recorder or the like, capable of displaying a plurality of parameters in graphical form as illustrated in FIG. 2.

In a presently preferred embodiment, the apparatus further comprises means for measuring while drilling one or more formation parameters. These MWD measurement sensors are typically located in one or more detail collars located some distance above the drill bit 40. For example, these MWD sensors are often located ten to thirty feet above the drill bit. The apparatus illustrated in FIG. 1 includes drill collars 34, 36 and 38 capable of including sensors for measuring various formation parameters at 24, 26 and 28, respectively. Exemplary parameters measured by MWD sensors include the porosity of the formation, the density of the formation, the resistivity of the formation and the $\gamma$-lithology of the formation. The data obtained by these illustrative MWD tools is encoded, transmitted to the surface, detected, decoded, processed and displayed by the apparatus and methods discussed above.

In the illustration of FIG. 1, the drill bit 40 has just recently passed through a formation 82 and penetrated into a new formation 84. Accordingly, those skilled in the art would recognize that the values of the formation parameters measured by the sensors of MWD tools 34, 36 and 38 at formation locations 24, 26 and 28, respectively, may be considerably different from the values of the same parameters of the new formation at the penetration face 22. Thus, with conventional MWD logging methods, the drilling operator and geologist remain unaware that the drill bit 40 has entered a new formation 84 until the drill string 32 has progressed sufficiently far into the borehole 20 so that the sensors of MWD tools 34, 36 and 38 have entered the new formation 84. Accordingly, they are unable to modify the drilling operation immediately to respond to the true formation parameters of the new formation 84 for improved efficiency and safety in the new formation 84.

However, the apparatus and method of the present invention provide a means for contemporaneously estimating values for a plurality of borehole parameters of the penetration face so that the drilling operation may be immediately modified where necessary or desirable to improve efficiency and safety. The apparatus of the present invention comprises means for measuring while penetrating one or more values indicative of one or more parameters of the formation face being penetrated. One or more parameters indicative of the formation face being penetrated, e.g., the drilling rate normalized for changes in the weight-on-bit or other measured parameters, the torque-on-bit, the pressure drop across the bit (drill string pressure less annulus pressure), the temperature, the acceleration, the bending moment or the like, is measured while penetrating the formation face. In an illustrative embodiment, an exemplary measurement-while-penetrating tool 42 included directly above the drill bit 40 in the drill string 32 makes these measurements. Values indicative of one or more of these characteristics of the formation face being penetrated are readily measured by conventional means in drill sub 42, coded and transmitted to the surface from drill sub 44, detected by data detection means 48, decoded and processed by data processing means 50 and displayed by data display means 52.

FIG. 2 is illustrative of simple strip chart recordings illustrating a first parameter of a formation face being penetrated drawn by pen 54 and displayed on the left chart. A second parameter of the same formation location but measured later while drilling is drawn by pen 56 and illustrated on the right chart. The distance between the face being penetrated by the drill bit and the location of the sensor detecting the measurement-while-drilling parameter is about twenty feet in the illustrative example. Accordingly, to simplify visual data analysis so that the values of a plurality of parameters at the same borehole location are illustrated in parallel, adjacent relation on the display means appropriate location compensation circuitry must be employed. Those skilled in the art will appreciate that there are many means and circuits to achieve the necessary compensation. FIG. 2 illustrates a device wherein data from the sensor of MWD tool 34 is correctly located on the visual display by means of electronic location compensator 58 to correctly position the pen 56.

Still referring to FIG. 2, visual observation of the data displayed from the sensor of MWP tool 42 shows a dramatic change in the value of the torque-on-bit displayed at (a) which might signal penetration by the drill bit of a new formation. Immediate knowledge of the estimated values of other formation parameters of the new formation, such as those parameters measurable by the sensors of MWD tools 34, 36 and 38 might be valuable to the drilling operator and geologist. Visual examination of parallel, strip charts such as the illustrative charts of FIG. 2 shows a similar change in the value of the torque-on-bit at (c). Accordingly, comparison with the value of the illustrated MWD parameter, $\gamma$-lithology, later measured and recorded at (c) permits the drilling operator or geologist to immediately and accurately estimate the value of the $\gamma$-lithology at (a). The operator or geologist may then modify the drilling operation as necessary or desirable for increased safety and efficiency.

Figure 3:
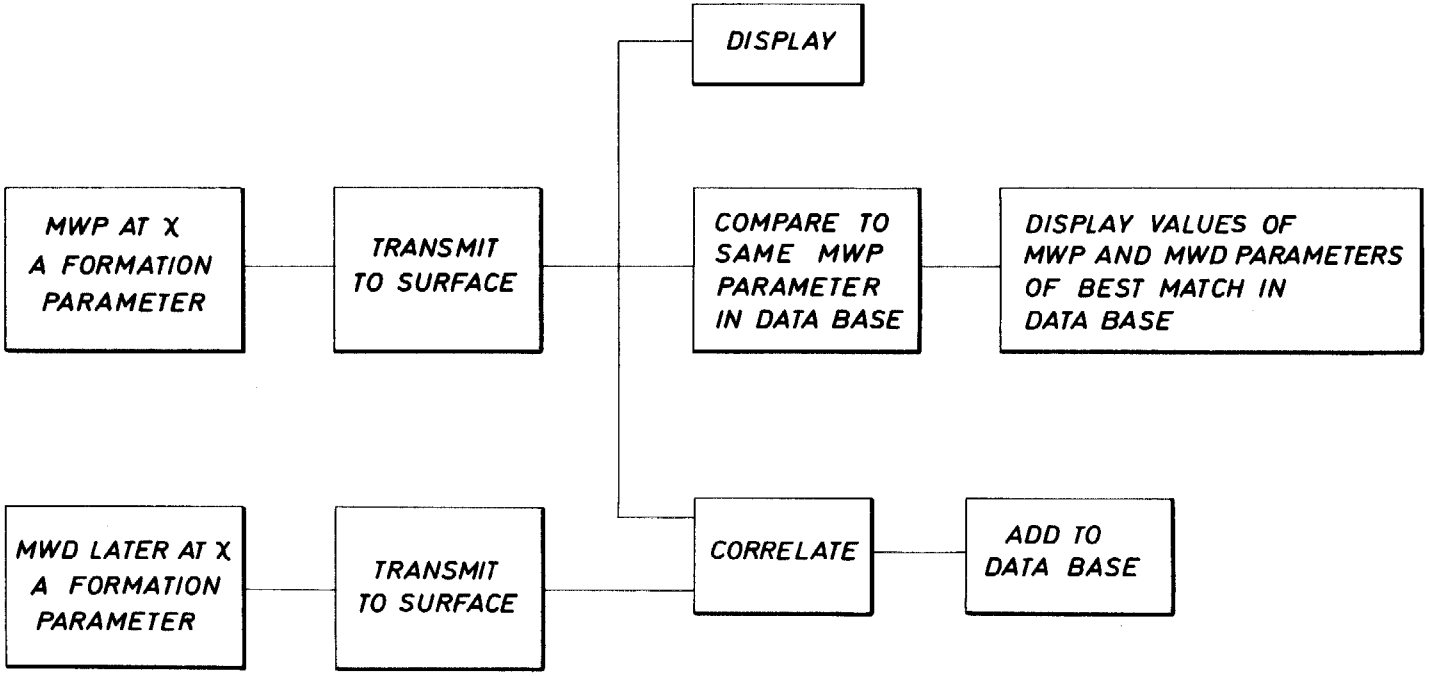
FIG. 3 is a flow chart for the method of the present invention for estimating the value of a given MWD parameter of the formation face being penetrated from the measurement of the value of a parameter measured while penetrating that formation face.
Figure 4:
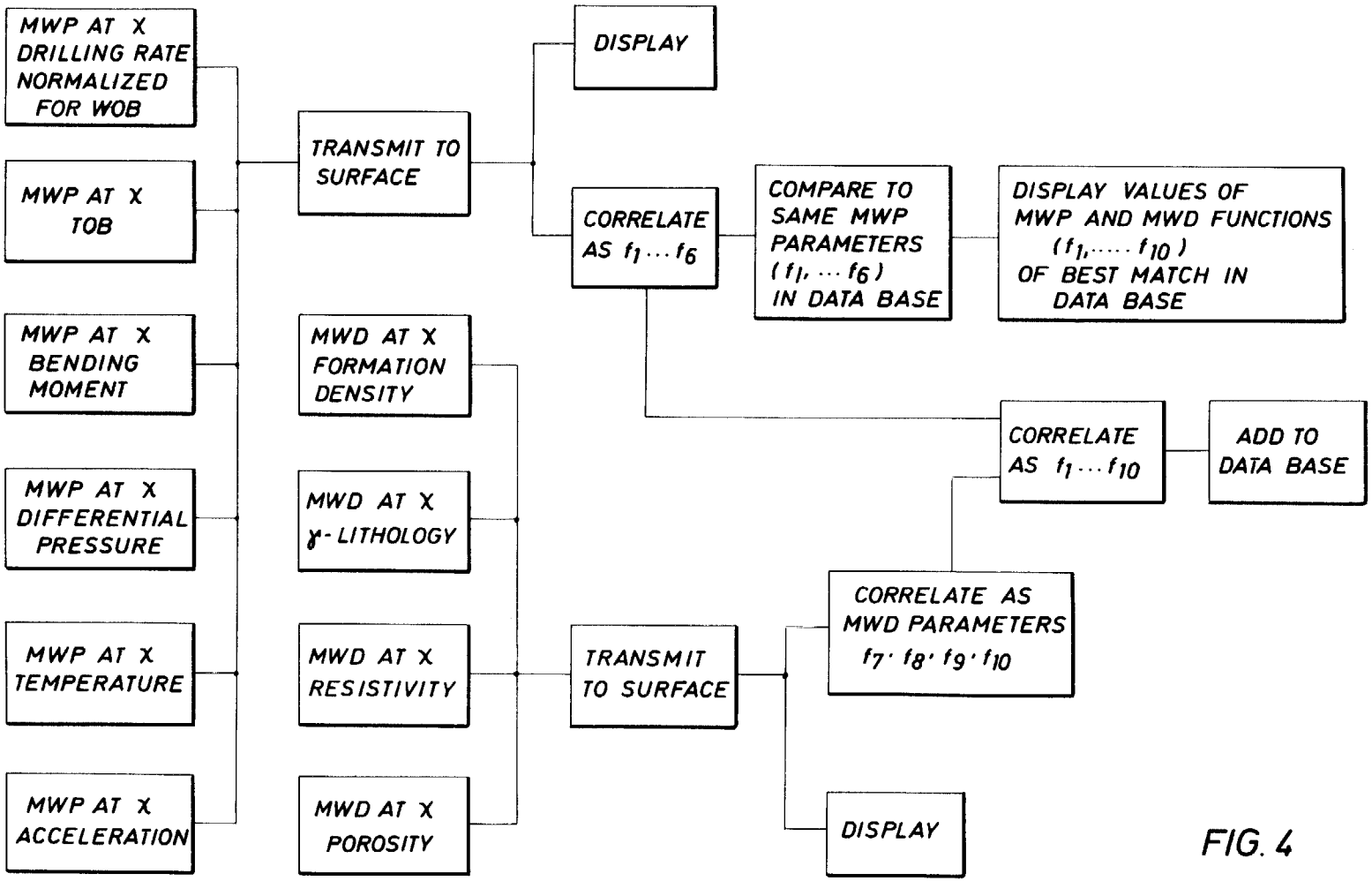
FIG. 4 is a flow chart for the method of the present invention for estimating the value of one or more of a plurality of MWD parameters of the formation face being penetrated from the measurement of the value of one or more parameters measured while penetrating that formation face.

The flow chart of FIG. 3 illustrates the method of the present invention. The method comprises measuring-while-penetrating a value indicative of a parameter of the formation face being penetrated. If the location within the borehole of the formation face is known, the value of the MWP parameter may be correlated with values of other parameters after acquired by MWD or wireline logging to expand the data base. Exemplary parameters which are measurable are illustrated in FIG. 4 and include the penetration rate normalized for changes in the weight-on-bit or other measured parameters, the torque-on-bit, the pressure drop across the bit, the bending moment, the temperature and the acceleration. The measured data is encoded and transmitted to the surface by conventional telemetry means, e.g., a negative pressure pulse telemetry system. The data is received and decoded at the surface where the measured value is compared to the measured value for the same parameter measured in the same manner in a plurality of sets of parameter values comprising a data base. Each set of values in the data base comprises values of formation parameters for a different borehole location and includes a value of the parameter measured while penetrating and a value of the parameter to be determined. The simplest comparison is merely a comparison of graphically displayed data sets as illustrated in FIG. 2. However, the preferred embodiment employs a computer or other digital comparison means to make more sophisticated comparisons. Those skilled in the art will appreciate that computer analysis of digitized data permits faster and more accurate estimation of the best match between the value of the measured parameter and the values of the same parameter in the data base, providing a better system for estimating the value of the parameter of interest. Those skilled in the art will readily appreciate that computerized analysis of digitized data permits fast and accurate estimations based on the values of a plurality of different parameters measured at the penetration face, further improving the accuracy and reliability of the estimated data. Even those skilled in the art would readily be overcome by the complexity of visually estimating the best match for a plurality of measured parameters against a massive data base comprising data accumulated throughout the drilling of the borehole of interest and many prior boreholes. Finally, the system of the present invention is adapted to display the value for the parameter(s) of interest as estimated from the comparison on appropriate visual or recording display devices.

The method and apparatus of the present invention are readily adapted to permit the data base to be constantly improved by addition thereto of the accumulated measurement-while-penetrating data together with any after acquired MWD or wireline data for the same location. This after acquired data is transmitted to the surface by any appropriate means and correlated with the measurement-while-penetrating data earlier obtained to provide additional sets of data to be added to the data base. Accordingly, this system permits the data base to be constantly expanded and improved as the borehole progresses.

The flow chart of FIG. 4 illustrates in somewhat more detail the method of the present invention for a system wherein up to six parameters are measured-while-penetrating. This exemplary system permits the estimation of values for up to four MWD or wireline parameters based on the measurement of any one or more of the illustrative MWP parameters. In general, based on the measurement of one or more parameters at the penetration face, this system permits the estimation of values for any of the MWP or MWD parameters within the data base but not actually measured at the penetration face.

The foregoing description of the invention has been directed in primary part to a particular preferred embodiment and method in accordance with the requirements of the patent statutes and for purposes of explanation and illustration. It will be apparent, however, to those skilled in the art that many modifications and changes in the specifically described apparatus and method may be made without departing from the scope and spirit of the invention. For example, Applicant has illustrated and described a device and method employing MWD sensors to acquire values for the after-acquired formation parameters to expand the data base. Applicant believes the disclosed apparatus and method provide the most advantageous use of the present invention. However, those skilled in the art will appreciate that after-acquired wireline data may be used in place of or in addition to the described MWD data to expand the data base and provide the ability to estimate values for additional parameters. Therefore, the invention is not restricted to the particular form of construction and method illustrated and described, but covers all modifications which may fall within the scope of the following claims.

It is Applicant's intention in the following claims to cover such modifications and variations as fall within the true spirit and scope of the invention.

What is claimed is:

1. A method for estimating a value of a property of a formation face being penetrated at a bottomhole location in a borehole by a drill bit in a drilling operation, comprising the steps of:

constructing a data base comprising a plurality of reference sets of correlated values, each said set corresponding to a known location within a borehole, each said set including a reference value indicative of said known location for each of a plurality of properties, said constructing comprising, measuring, while penetrating at each said known location, a value indicative of a first property of a formation face being penetrated at each said known location, measuring, later after drilling has progressed below each said location, a value indicative of a second property of a formation surrounding each said location, and correlating said measured values for said first and second properties for each said location to form each said reference set in said data base;

measuring, while penetrating at a new bottomhole location in said borehole, a test value indicative of said first property of a new formation face being penetrated at said new bottomhole location; and comparing said test value with said data base to provide an estimated value of said second property at said bottomhole location.

2. The method of claim 1 comprising in the step of constructing: measuring for each said location a plurality of values indicative of a plurality of different second properties of said formation at each said location and correlating for each said location said first property for each said location with said second properties for each said location.

3. The method of claim 2 comprising in the step of constructing: measuring a plurality of values indicative of a plurality of different, first properties of said formation at each said location and correlating for each said location said different, first properties for each said location with said different, second properties for each said location.

4. The method of claim 1 comprising storing said reference sets in a data storage means.

5. The method of claim 4 comprising comparing both the magnitude of said test value at said new bottomhole location and the direction and rate of change for said test value of said first property at said new bottomhole location and a plurality of locations immediately preceding said new bottomhole location with the magnitude of a value of said first property in said reference sets and the direction and rate of change of said first property for said reference sets of properties of adjacent locations in said borehole.

6. The method of claim 4 wherein said data base includes reference sets of correlated values obtained in other boreholes and said step of comparing comprises:

firstly, comparing the value of said first property of said bottomhole location with the value of the first property of each set of values from said borehole being drilled and, if a substantial match is not obtained, secondly, comparing the value of said first property of said bottomhole location with the value of the first property of each set of values from said other boreholes until the best match is obtained.

7. The method of claim 6 comprising comparing by computer means the value of said measured first property to the value of said first property of each said reference set.

8. A method for estimating a value of a property of a formation face being penetrated at a bottomhole location in a borehole by a drill bit in a drilling operation, comprising the steps of:

measuring, while penetrating at a bottomhole location in a borehole, a test value indicative of a first property of a formation face being penetrated at said location; and comparing said test value with a data base to provide an estimated value of a second property at said bottomhole location, said data base comprising a plurality of reference sets of correlated values, each said set corresponding to a known location in a borehole, each said set including a first reference value indicative of said first property at said known location, measured while penetrating at said known location, and a second reference value indicative of said second property at said known location, measured later after drilling has progressed below said location.

9. The method of claim 8 comprising comparing by computer means the value of said measured first property to the value of said first property of each said reference set.

10. The method of claim 8 further comprising:

measuring at a later time a value indicative of said second property at said bottomhole location; and adding to said data base said test value of said first property, measured while penetrating, and said measured value of said second property, measured at a later time, said test value and said measured value correlated into a set of reference values corresponding to the correlated formation properties of said data base.

11. The method of claim 10 comprising measuring while drilling to obtain said measured, second value at a later time.

12. The method of claim 11 comprising measuring by wireline logging to obtain said measured, second value at a later time.

13. An apparatus useful for estimating a value of a property of a formation face being penetrated at a bottomhole location by the drill bit in a drilling operation, comprising in combination:

means for storing a data base comprising a plurality of sets of values of correlated formation properties, each set comprising values for at least first and second properties for a known location within a borehole, each said first property obtained by measuring, while penetrating at said location, and each said second property obtained by measuring, later after drilling has progressed below said location;

means for measuring, while penetrating at said bottomhole location, a value indicative of said first property of a formation face being penetrated at said bottomhole location; and means for comparing said measured value of said first property at said bottomhole location to the corresponding value of said first property of each set in said data base to identify a set of values whose value of said first property most closely approximates said measured value to estimate a value of said second property at said bottomhole location.

14. The apparatus of claim 13 further useful for estimating the values of a plurality of properties of the formation face being penetrated wherein each set in said data base comprises values for a plurality of different, first properties and a plurality of different, second properties and said apparatus comprises:

means for measuring, while penetrating at said bottomhole location, values indicative of each of said plurality of different, first properties of said formation face being penetrated at said bottomhole location; and means for comparing each of said measured values of said different, first properties to the corresponding values of said different, first properties of each set in said data base to identify a set of values whose first properties most closely approximate said measured values to determine an approximate value for each of said plurality of different, second properties at said formation face at said bottomhole location.

15. The apparatus of claim 13 further comprising in combination:

means for determining the location of said formation face being penetrated at said bottomhole location within said borehole;

means for measuring, later while drilling below said bottomhole location, a value of said second property at said bottomhole location; and means for adding to said data base a new set of values indicative of said bottomhole location, said set comprising said measured value of said first property measured while penetrating at said bottomhole location, and said measured value of said second property measured, while drilling below said bottomhole location, correlated into a set of values corresponding to the correlated formation properties of said data base.

16. The apparatus of claim 13 wherein said means for comparing comprises visual display means.

17. The apparatus of claim 13 wherein said means for comparing comprises computerized comparison means.

* * * * *

UNITED STATES PATENT AND TRADEMARK OFFICE

CERTIFICATE OF CORRECTION

PATENT NO. : 4,697,650

DATED : October 6, 1987

INVENTOR(S) : John E. Fontenot

It is certified that error appears in the above-identified patent and that said Letters Patent is hereby corrected as shown below:

In Column 9, line 44, delete "11" and insert therefor --10--.

Signed and Sealed this

Fifth Day of July, 1988

*Attest:*

DONALD J. QUIGG

*Attesting Officer*

*Commissioner of Patents and Trademarks*